United States Patent [19]

Dittman et al.

[11] Patent Number: 4,702,710

[45] Date of Patent: Oct. 27, 1987

[54] WATERPROOF SEAL ASSEMBLY FOR ELECTRICAL CONNECTOR

[75] Inventors: William J. Dittman, Marietta; Luther S. Ward, Winston, both of Ga.

[73] Assignee: Georgia Tech Research Corporation, Atlanta, Ga.

[21] Appl. No.: 876,396

[22] Filed: Jun. 20, 1986

[51] Int. Cl.[4] ..... H01R 13/52

[52] U.S. Cl. ..... 439/271; 439/125; 439/548; 439/932

[58] Field of Search ..... 339/26, 94 R, 94 C, 339/94 M, 126 J, 126 RS, 127 R, 127 C, 129, 130 R, 130 C, DIG. 1, 60 R, 60 M, 61 R, 61 M

[56] References Cited

U.S. PATENT DOCUMENTS

| | | | |
|---|---|---|---|
| 2,552,686 | 5/1951 | Melcher | 339/130 C X |
| 2,665,673 | 1/1954 | Woofter | 339/26 |
| 2,904,769 | 9/1959 | Sampson et al. | 339/26 |
| 3,124,405 | 3/1964 | Massa | 339/60 R |
| 3,297,819 | 1/1967 | Wetmore | 174/127 |
| 3,321,733 | 5/1967 | Thomas | 339/94 R X |
| 3,370,112 | 2/1968 | Wray | 264/22 |
| 3,708,611 | 1/1973 | Dinger | 339/DIG. 1 X |
| 3,760,327 | 9/1973 | Whitehead | 339/126 RS X |

*Primary Examiner*—Gil Weidenfeld
*Assistant Examiner*—Steven C. Bishop
*Attorney, Agent, or Firm*—Newton, Hopkins & Ormsby

[57] ABSTRACT

A waterproof seal assembly for electrical connectors is disclosed having an elastomeric sleeve which encircles a portion of the cable and the plug end of the electrical connector. An adaptor, used to secure the receiving jack, extends from the securing point to meet the sleeve, thereby completely encircling the connection. A sealing bead may be provided on the inner surface of the sleeve to engage the adaptor and seal out moisture, dust, and other corrosive contaminants.

19 Claims, 4 Drawing Figures

WATERPROOF SEAL ASSEMBLY FOR ELECTRICAL CONNECTOR

This invention was made with government support under Contract No. DAAK40-79-C-0284, awarded by the U.S. Army. The government has certain rights in this invention.

BACKGROUND OF THE INVENTION

Electronic signals are often transmitted through cables that terminate with a coaxial connector. The connectors, a common type of which is known as a BNC plug, serve as the interface between additional lengths of cable, electronic equipment, and test equipment designed for use with the systems. The need for this interfacing capability required the same type of connector be used both indoors and outside.

Unprotected connectors used outside are subject to corrosion, which results in signal loss and equipment failure. With the increasing use of coaxial connectors, maintenance has become an expensive and time-consuming, but necessary routine. This problem is especially troublesome in, for example, coastal installations and other hostile environments, where corrosive salt spray or dust attacks and disables the connectors.

Present policies include the regular changing of corroded, and therefore, useless plugs. While replacement itself is relatively simple, the connectors which require the most attention are often in areas which have, as stated, hostile environments, or which are distant or difficult to access. Thus, much time and expense must be allocated to routine maintenance of the systems.

Attempts to develop water-resistant connectors have been generally unsuccessful, the water-resistant connectors also being, in large part, site-specific. Thus, their application is limited to certain installations and/or environments, and their use has generally resulted in continuing corrosion problems. In addition, the current generation of water-resistant connectors are generally incompatable with commonly-used test equipment, which is normally equipped with a standard indoor coaxial connector, such as a BNC plug. In order to use the test equipment on the outside installations, adaptors had to be provided, or modifications made in the connection, simply to test the outdoor system. This also entailed further delays and expenses, in time, materials and man-hours.

SUMMARY OF THE INVENTION

It is, therefore, one of the principal objects of the present invention to increase the useful life span of electrical connectors by providing a waterproof seal assembly for the connectors which is effective to seal out moisture, dust and other corrosive foreign agents from the connectors.

Another object of the present invention is to provide a waterproof seal for electrical connectors that is easily installed over existing connectors and which can be withdrawn from engagement with the connector, should repair or replacement of the connector become necessary or desirable, and then easily re-installed over the new or repaired connector.

A further object of the present invention is to provide a waterproof seal for electrical connectors that can easily withstand extreme temperatures and environmental conditions and which is durable to provide a long service life.

These and additional objects are attained by the present invention which relates to a waterproof seal assembly for electrical connectors having a sleeve means or main body portion defining a passageway therethrough. One end of the body portion has a relatively small opening for sealing to the coaxial cable, while the opposite end is designed to envelop and seal an electrical connector. Integral and extraneous sealing means are provided, thus effecting essentially complete sealing of the connector. Various materials are suitable for producing the present invention, for example, plastics, natural or synthetic rubber, and similar elastomeric materials all provide the requisite sealing capacity.

Various additional objects and advantages of the present invention will become apparent from the below description, with reference to the accompanying drawings.

DETAILED DESCRIPTION OF THE PREFERRED EMBODIMENT

Figure 1:
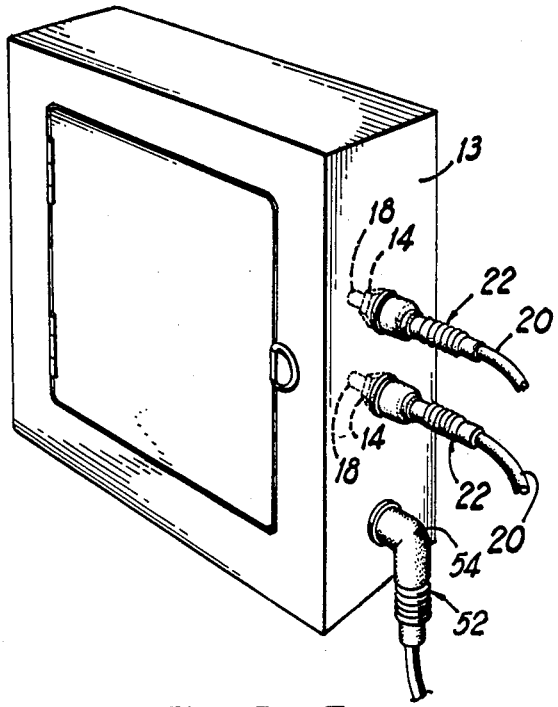
FIG. 1 is a perspective view of the present waterproof sealing assembly for electrical connectors, the assembly shown installed in one possible application.
Figure 2:
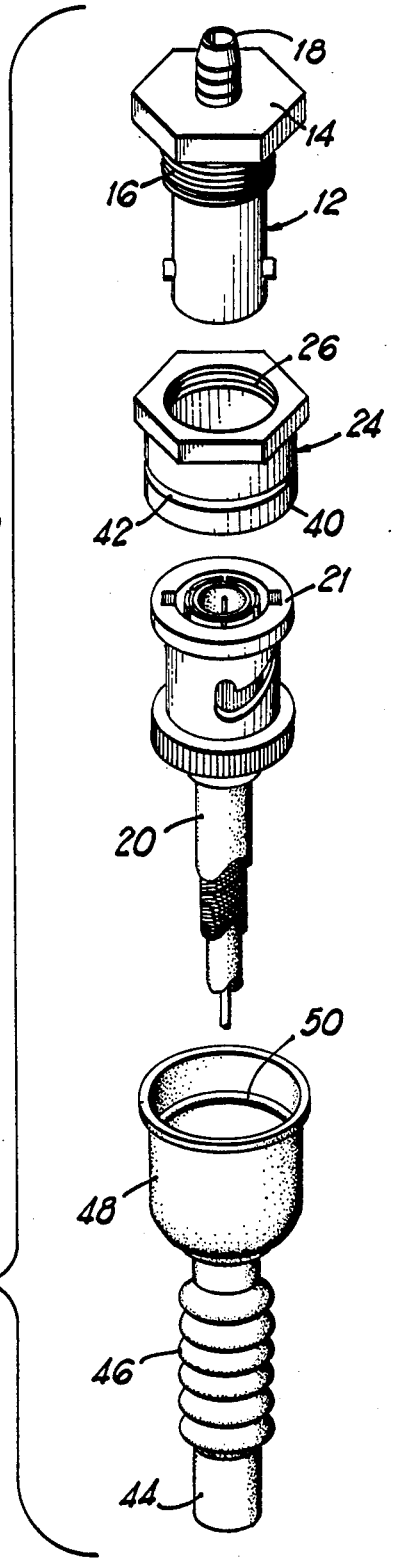
FIG. 2 is an exploded, perspective view of the present waterproof sealing assembly for electrical connectors.

Referring now more specifically to the drawings, and to FIG. 1 in particular, numeral 10 designates generally the waterproof sealing assembly for electrical connectors. One possible installation has a female jack 12 inserted through a hole in, for example, a bulkhead or wall 13 with the nut 14 on one side and the screw threads 16 projecting through the wall to the opposite side. A thin metal nut (not shown) is then normally applied to the threaded end to hold the jack in the wall. This installation is shown as an example only and is not meant to limit the present invention in any way.

Nut 14, and the receptacle 18 associated therewith, are normally located inside a building, cabinet, or other protected enclosure, and a cable (not shown) extends from receptacle 18 to its termination point. The coaxial cable 20, shown here, and the male plug 21, here shown as a typical BNC connector, extend from an outside installation, for example, a satellite receiving dish, to the female jack 12. The plugs are secured together in any suitable manner and have normally been left unprotected, thus subjecting the connection to corrosive elements.

The present invention includes an elastomeric sleeve means or boot 22 and an elongated securing means, such as a hermetic adaptor 24. The boot extends axially from the cable 20 to the hermetic adaptor 24, which is designed to replace the thin metal nut (not shown) which was formerly used to secure jack 12 in a wall or similar structure. The adaptor may be composed of a suitable non-corrosive material, such as aluminum or plastic and has threads 26 formed in the inner circumferential surface thereof for mating with the threads 16 of the female jack. This secures the jack in the wall, with a sealing means such as an O-ring 28 being provided in a groove (not shown) adjacent the nut 14, to seal against the wall or bulkhead. An additional sealing means 30 such as another O-ring or a silicone compound may be provided between the adaptor 24 and the wall.

Figure 3:
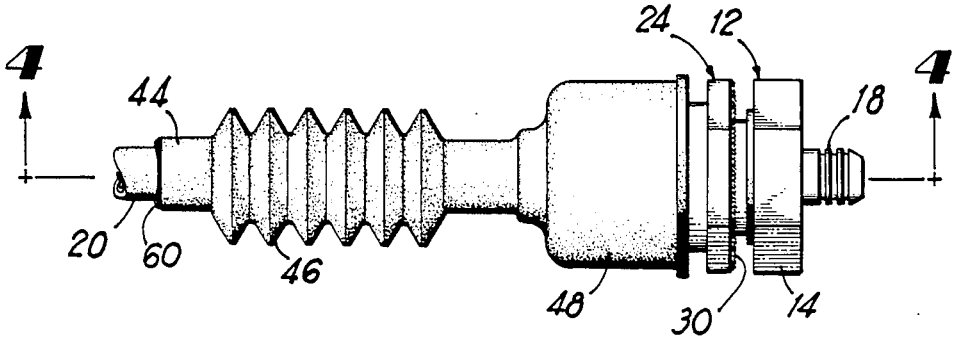
FIG. 3 is a side elevational view of the present invention, shown here assembled around a connector.
Figure 4:
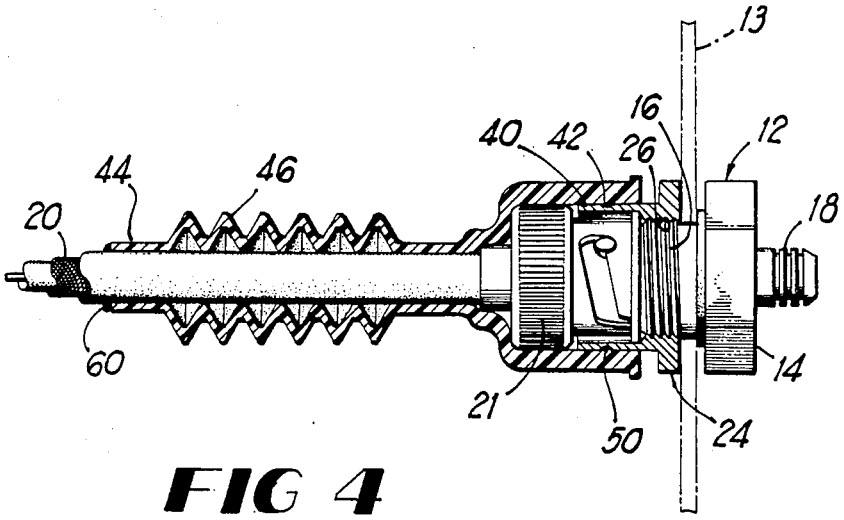
FIG. 4 is a cross-sectional view of the present invention, the section being taken on line 4—4 of FIG. 3.

Adaptor 24 has an elongated body portion 40 with an annular groove means 42 formed in the outer circumferential surface thereof. The adaptor is of a length sufficient to extend axially from the connection point at the wall and encompass the connecting means which secure the jack and incoming plug together, here shown as a pin and slot connection. Thus, the length of the adaptor may vary, depending on the particular jack being used, one embodiment being illustrated in FIG. 3.

The boot 22 is of one-piece construction and may be composed of any suitable elastomeric material, such as certain plastics, natural or synthetic rubber, and the like. The invention also may be practiced with a heat-shrinkable material, a general example being similar to that disclosed in U.S. Pat. Nos. 3,297,819 or 3,370,112 to Raychem Corp.

The boot has three regions, a narrow tubular section 44, a convoluted tubular section 46, and a relatively wide tubular section 48. Narrow section 44 has an inside diameter only slightly larger than the outside diameter of the cable, so as to grip the cable tightly when installed or shrunk into place. The convoluted section allows the boot to be retracted should repair or replacement of the plug be required, and then restored to its normal length. The wide section 48 is designed to encompass adaptor 24. A sealing means, such as annular bead 50, is provided on the inner circumferential surface of the wide section of the boot, and mates with the groove 42, effecting the seal and providing a positive snap-in indication that the connection has been made. If desired, more than one sealing means may be employed in this area, and such construction is considered within the scope of the present invention.

As shown in FIG. 1, the boot may be formed as a substantially straight member, or it may be formed with as much as a ninety degree angle, depending on the particular application, this being designated generally by numeral 52. The angular portion 54 of the boot may be molded to the desired angle, or it may be convoluted to permit bending to the required angle for making the connection.

Sealing of the narrow section 44 around the cable is accomplished in any suitable manner. With heat-shrinkable material for the boot, the narrow section may be constructed so as to sealingly grip the cable when shrunk. An alternate method is to provide an adhesive between the cable and the inner wall of section 44. A third alternative is the external application of a suitable sealant 60, such as a silicone, around the outer edge of the narrow section and the encompassed cable.

In the use and operation of the present waterproof seal for electrical connectors, the plug 22 and jack 12 are checked for corrosion or moisture and dried or replaced if necessary, since the present invention also seals in any existing moisture. Heat-shrinkable embodiments may be slipped over the end of the plug 22 and shrunk into place with the application of hot air. A molded embodiment would normally be installed by cutting off the old plug, slipping the present seal over the end, and then re-installing a plug on the end, or if length permits, by sliding the seal 10 over the cable to the plug.

The conventional, thin securing nut (not shown) is removed from the jack 12 and replaced by the hermetic adaptor 24, thus providing a surface around which boot 22 may seal. With the components in place, the boot is pulled rearwardly with respect to the jack so that the jack and plug may be connected, whereupon the boot is released and reassumes its normal length. A final, slight forward movement of the boot is made to engage the sealing bead 50 with groove 42 in the adaptor.

Sealing of the narrow section 44 of the boot to the surrounded cable is accomplished either by the tight fit of the heat-shrunk boot section, an internal adhesive or sealant between the section 44 and the cable, or an externally applied sealant, such a a silicone.

The invention thus provides a seal around an electrical connection that is resistant to moisture, dust, and temperature extremes. Maintenance expenses are greatly reduced due to the increased life span of the connectors, and the present seal itself is reusable. In addition, the same type connector, for example, a BNC plug may be used outside as well as inside, and on test equipment, thus insuring compatability between the ouside connectors and the test equipment and facilitating the testing procedures.

While an embodiment of a waterproof seal assembly for electrical connectors and modifications thereof have been shown and described in detail herein, various other changes and modifications may be made without departing from the scope of the present invention.

We claim:

1. A waterproof seal assembly for an electrical connector disposed on a cable comprising a threaded receiving jack designed for insertion through an aperture in a wall member with the threaded portion projecting through said aperture, an elastomeric sleeve means having a passageway therethrough for encompassing the cable means and the electrical connector, elongated securing means having threads formed therein for mating with said threaded portion of said receiving jack and securing said jack in said aperture, said securing means extending axially from the receiving jack and having sufficient diameter to encompass a portion of the electrical connector and to be received within said sleeve means, and a sealing means disposed at the interface of said sleeve means and said securing means.

2. A waterproof seal assembly as defined in claim 1 in which said sleeve means has three regions, a relatively narrow region for closely enveloping the cable, a length-adjustable convoluted central region, and a relatively wide region for enveloping the connector.

3. A waterproof seal assembly as defined in claim 2 in which said wide region has an inner circumferential surface with a sealing bead disposes thereon for sealing against said securing means.

4. A waterproof seal assembly as defined in claim 1 in which said sleeve means includes a length-adjustable boot having an inner circumferential surface with an annular sealing bead disposed thereon for sealing against said securing means.

5. A waterproof seal assembly as defined in claim 4 in which said securing means includes an elongated, hermetic adaptor having an outer circumferential surface with an annular groove means formed therein for receiving said sealing bead.

6. A waterproof seal assembly as defined in claim 1 in which said sleeve means includes a length-adjustable boot having an inner circumferential surface with a sealing bead disposed thereon for sealing against said securing means.

7. A waterproof seal assembly as defined in claim 6 in which said adaptor has an outer circumferential surface with a groove means formed therein for receiving said sealing bead.

8. A waterproof seal assembly as defined in claim 1 and including a sealant means for sealing said sleeve means to the cable.

9. A waterproof assembly for an electrical connector disposed at one end of a cable and having threaded receiving jack for the connector disposed through an aperture in a wall with the threaded portion projecting therethrough, said assembly comprising an elastomeric sleeve means having a passageway therethrough for encompassing the cable and the connector, said sleeve means having a narrow opening for closely encircling the cable and a wider portion for closely encircling the connector, and elongated securing means fixed to the receiving jack having a threaded portion for engaging and retaining said jack in the wall, said securing means extending from the jack to a point encompassing the point of connection of the electrical connector and the jack, and said sleeve means extending around and over said securing means for sealing around the connection.

10. A waterproof seal assembly as defined in claim 9 in which said wider portion has an inner circumferential surface with a sealing bead disposed thereon for sealing against said securing means.

11. A waterproof seal assembly as defined in claim 10 in which said securing means includes an elongated, hermetic adaptor having an outer circumferential surface with a groove means formed therein for receiving said sealing bead.

12. A waterproof seal assembly as defined in claim 9 in which said sleeve means includes a length-adjustable boot having an expandable and contractible convoluted portion disposed between said narrow portion and said wider portion.

13. A waterproof seal assembly as defined in claim 9 in which said receiving jack has a threaded portion and said securing means includes an hermetic adaptor having a threaded portion for receiving the threaded portion of the jack for securing the jack in a fixed position in walls and the like.

14. A waterproof seal assembly as defined in claim 9 in which said assembly includes a sealant means for sealing said narrow portion to the cable.

15. A waterproof seal assembly for an electrical connector disposed at one end of a cable, and assembly comprising in combination, a wall portion having apertures formed therein, a receiving jack for the connector designed for insertion through an aperture in said wall portion and having means for accepting a securing means for retaining said jack in said wall portion, an elastomeric sleeve means having passageway therethrough for encircling the connector and a portion of the cable, an elongated securing means having means for engaging said means of said jack for retaining said jack in the wall portion, said securing means extending axially from the jack to a point encompassing the point of connection of the jack with said connector, and a sealing means disposed at the point of engagement of said connector and said securing means.

16. A waterproof seal assembly as defined in claim 15 in which said sleeve means includes a length-adjustable boot composed of a heat-shrinkable material having an inner circumferential surface with a sealing bead disposed thereon for sealing against said securing means.

17. A waterproof seal assembly as defined in claim 16 in which said securing means includes an elongated, hermetic adaptor having an outer circumferential surface with a groove means formed therein for receiving said sealing bead.

18. A waterproof seal assembly as defined in claim 15 in which said sleeve means has three regions, a relatively narrow region for closely enveloping the cable, a length-adjustable central region, and a relatively wide region for enveloping the connector, said wide region being angularly disposed with respect to said central region, within the range of zero to ninety degrees.

19. A waterproof seal assembly as defined in claim 18 in which said wide region has an inner-circumferential surface with a sealing bead disposed thereon for sealing against said securing means.

* * * * *